US007100670B1

(12) United States Patent
Hofman et al.

(10) Patent No.: US 7,100,670 B1
(45) Date of Patent: Sep. 5, 2006

(54) METHOD FOR FABRICATING URANIUM FOILS AND URANIUM ALLOY FOILS

(75) Inventors: Gerard L. Hofman, Downers Grove, IL (US); Mitchell K. Meyer, Idaho Falls, ID (US); Gaven C. Knighton, Moore, ID (US); Curtis R. Clark, Idaho Falls, ID (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 280 days.

(21) Appl. No.: 10/660,592

(22) Filed: Sep. 12, 2003

(51) Int. Cl.
*B22D 7/00* (2006.01)
*B22D 11/12* (2006.01)
*B21B 1/36* (2006.01)

(52) U.S. Cl. ..... 164/76.1; 164/476; 164/477; 29/527.7

(58) Field of Classification Search ..... 164/76.1, 164/476, 477; 29/527.7
See application file for complete search history.

(56) References Cited

U.S. PATENT DOCUMENTS

| | | | | |
|---|---|---|---|---|
| 3,647,939 | A * | 3/1972 | Schoerner | 174/128.1 |
| 4,604,148 | A * | 8/1986 | Anderson | 148/560 |
| 2002/0050335 | A1 * | 5/2002 | Kim et al. | 164/463 |

* cited by examiner

*Primary Examiner*—Kuang Y. Lin
(74) *Attorney, Agent, or Firm*—Mark F. LaMarre; Thomas G. Anderson; Paul A. Gottlieb

(57) ABSTRACT

A method of producing thin foils of uranium or an alloy. The uranium or alloy is cast as a plate or sheet having a thickness less than about 5 mm and thereafter cold rolled in one or more passes at substantially ambient temperatures until the uranium or alloy thereof is in the shape of a foil having a thickness less than about 1.0 mm. The uranium alloy includes one or more of Zr, Nb, Mo, Cr, Fe, Si, Ni, Cu or Al.

21 Claims, 7 Drawing Sheets
(2 of 7 Drawing Sheet(s) Filed in Color)

Figure 3. Surrogate Target Assembly

METHOD FOR FABRICATING URANIUM FOILS AND URANIUM ALLOY FOILS

The United States Government has rights in this invention pursuant to Contract No. W-31-109-ENG-38 between the U.S. Department of Energy (DOE) and The University of Chicago.

FIELD OF THE INVENTION

The invention relates to the production of thin foils of uranium or a uranium alloy by cold rolling at ambient temperatures.

BACKGROUND OF THE INVENTION

To reduce nuclear-proliferation concerns, it is desirable to curtail the worldwide use of high-enriched uranium (HEU) by substituting low-enriched uranium (LEU) for research reactor fuel and medical isotope targets. Low-enriched uranium contains <20% $^{235}$U. Presently, most research reactors have converted their driver fuel from HEU to LEU; however, several high power reactors require fuel with uranium densities not attainable with dispersion designs. Fuel designs consisting of a solid uranium alloy core rather than uranium alloy—Al dispersions as the fissile part of the fuel will enable conversion of most remaining HEU fueled reactors.

Currently, most of the world's supply of $^{99}$Mo for medical diagnostics use is produced by fissioning the $^{235}$U in HEU targets, generally enriched to 93% $^{235}$U. After irradiation, the $^{99}$Mo is separated from the uranium and activation and fission products. Targets have been developed that use uranium alloys to allow the facile transition from HEU to LEU. These targets have been so successful that many producers have completed feasibility studies and moved into planning for their conversion to LEU.

SUMMARY OF THE INVENTION

Accordingly, it is a principal object of this invention to provide a low cost innovative method for producing thin foils of uranium or uranium alloys and articles made thereby.

Another object of the present invention is to provide a method of producing thin foils of uranium or an alloy thereof, comprising casting the uranium or alloy thereof into a plate or a sheet having a thickness less than about 5 mm and thereafter cold rolling the uranium or alloy thereof at substantially ambient temperatures until the uranium or alloy thereof is in the shape of a foil having a thickness less than about 1.0 mm and typically 0.1–0.3 mm.

Still another object of the invention is to provide a method of rapidly annealing uranium or uranium alloy sheet or foil made by the above method comprising applying an electrical potential across the sheet or foil to heat the sheet or foil to a temperature sufficient to relieve hardness and residual stress introduced by cold rolling.

A final object of the invention is to provide an inexpensive, rapid method for final heat treating and annealing uranium and uranium alloys by resistance heating the same and articles made thereby.

Additional advantages, objects and novel features of the invention will become apparent to those skilled in the art upon examination of the following and by practice of the invention.

BRIEF DESCRIPTION OF THE DRAWINGS

The patent or application file contains at least one drawing executed in color. Copies of this patent with color drawings will be provided by the Patent and Trademark Office upon request and payment of the necessary fee.

DETAILED DESCRIPTION OF THE INVENTION

Figure 1:
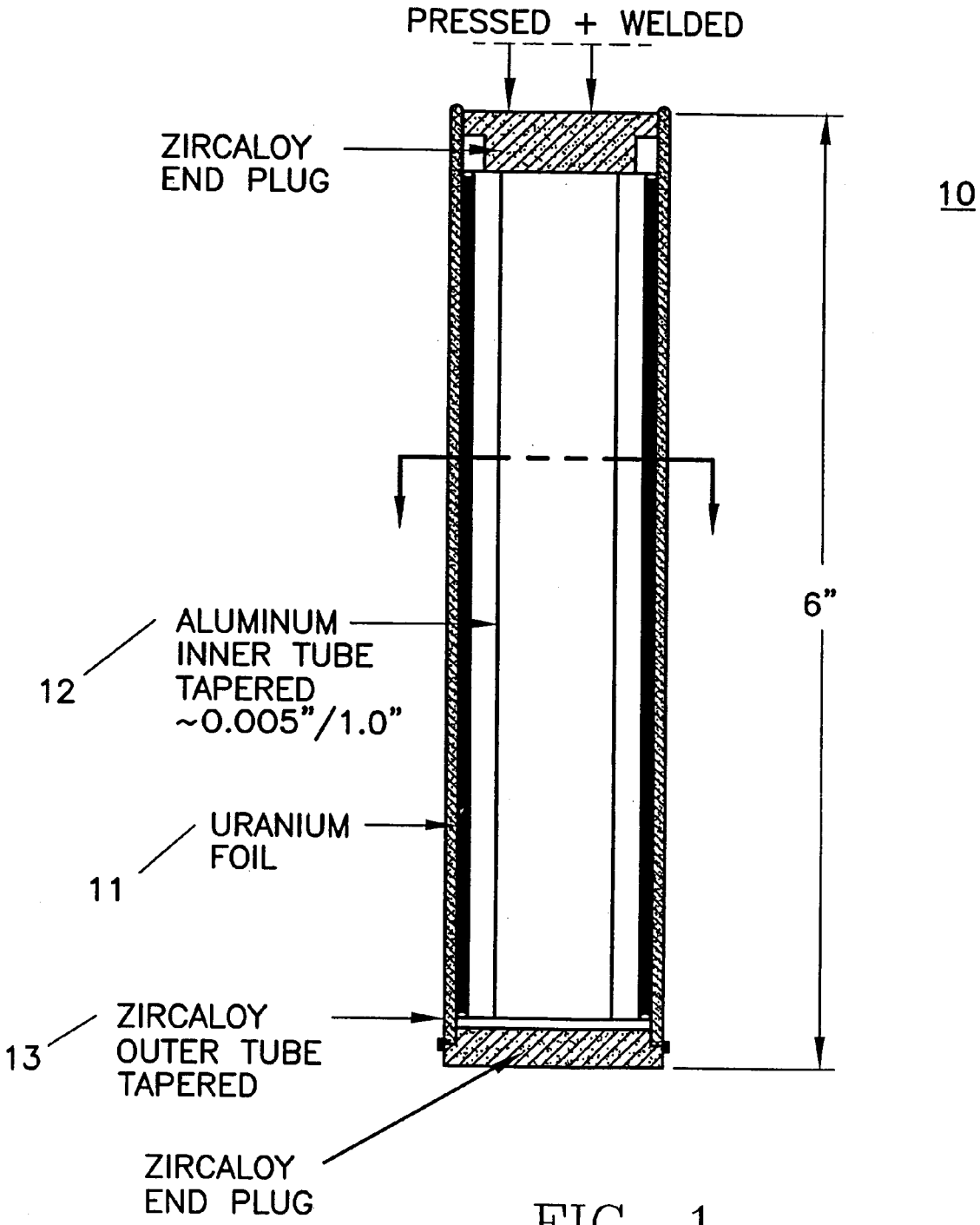
FIG. 1 is a longitudinal cross-sectional view of a differential thermal expansion target for the production of the isotope $^{99}$Mo.

This invention relates to an improved cost-effective method for fabricating thin foils of uranium or uranium alloys. Foils of low enriched uranium and uranium alloys are used as targets for isotope production or for research reactor fuel elements. For example, foils of about 0.1 mm thickness consisting of pure uranium metal or adjusted uranium alloy are utilized as targets for $^{99}$Mo isotope production. A thicker foil of approximately 0.25 mm thickness, consisting of uranium alloyed with up to 12 weight percent molybdenum, is useful for high-density monolithic research reactor fuel elements. The foils are currently fabricated by hot rolling thick metal ingots into the form of foil. Because uranium is chemically reactive with oxygen and nitrogen at high temperatures, it must be protected from contact with air by canning or sealing the uranium ingots in welded steel covers or cans. While this method produces usable foils, it is time-consuming and expensive, since because of weld deterioration during the rolling process, the foil must be recanned several times during the multiple steps of the hot-rolling process.

The invention includes cold rolling the uranium or uranium alloy at room temperature. Since uranium is unreactive at this temperature, it is no longer necessary to can the uranium to protect it from oxidation by air. In order to cold roll the uranium, it is necessary to start with a uranium or uranium alloy ingot that is as close as practicable, dimensionally, to the final foil dimensions. For example the ingot is cast in the form of a strip of up to about 5 mm but preferably about 2 mm thickness and of variable width depending on the final foil dimensions. Cold rolling can be employed to reduce the thickness by about 50% per cold rolling pass, but preferably not greater than 10%. After a total cold rolling reduction which introduces unacceptable strain hardness, and depending on alloy content, the foil may require an annealing treatment in a protective atmosphere to restore ductility of the metal, or preferably resistance annealing, after which a further thickness reduction may be performed if required. Resistance annealing refers to herein as the process of passing an electric current through the metal to heat the material to such temperatures as referred to in this application. The final required thickness and alloy content will determine the number of cold rolling-annealing steps required.

For $^{99}$Mo targets, which require relatively small foils, the ingots can be formed by gravity casting into a vertically oriented rectangular mold made from glass or ceramic material or cooled metal molds or uncooled metal molds. The ingot may be cast in the form of a strip of approximately 1 to 2 mm thickness and of variable width. For larger uranium-molybdenum alloy fuel element foils, a similar large ingot can be formed using the injection-casting technique developed by Argonne National Laboratory for metallic EBR-II driver fuel, or by pouring molten material into a horizontally oriented mold.

Figure 2:
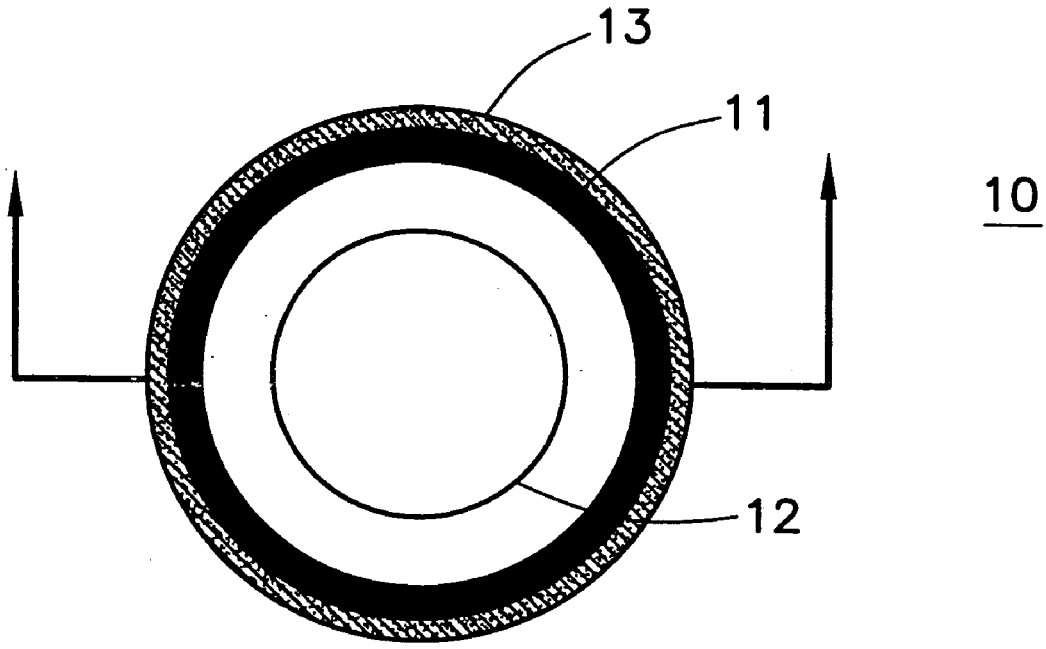
FIG. 2 is a horizontal cross-sectional view of the target illustrated in FIG. 1.

Design and irradiation tests have been conducted on test targets shown in FIGS. 1 and 2 and have the same or similar dimensions (except length) and appearance to the presently used $UO_2$-coated "Cintichem" targets. Referring to FIGS. 1 and 2, the fissile part of the target 10 is a thin (125-μm-thick) uranium metal foil "sandwiched between slightly tapered inner tubes 12 and outer tubes 13, respectively. The inner tube 12 is made of a material with a larger thermal expansion coefficient than the outer tube 13 material in order for the differential thermal expansion to assist in maintaining good thermal contact between the foil and the tubes 12 and 13. The taper and the greater shrinking of the inner tube 12 upon cooling after irradiation facilitates disassembly. Thin oxide layers were produced on the inner tubes 12 and outer tubes 13 tubes to serve as diffusion barriers to inhibit diffusion bonding of the uranium to the inner and outer tubes. The original intent was to separate the irradiated foil from the tubes, so that only the foil need be dissolved to recover the molybdenum. The target 10 was equipped with a compression-type fitting that allowed evacuation and back filling with He prior to irradiating as well as fission gas removal after irradiation.

Out-of-reactor thermal tests had shown, as reported by T. C. Wiencek et al., "*LEU $^{99}$Mo Target Fabrication and Testing*," Proceedings of 1994 International Meeting on Reduced Enrichment for Research and Test Reactors, Williamsburg, Va. USA (1994), herein incorporated by reference that a thin aluminum oxide layer prevented any interdiffusion between the uranium foil and the aluminum tube during a six-day test at 400° C.—a temperature substantially higher than expected to occur during irradiation of the target. The initial irradiation tet showed that radiation rendered the oxide layer ineffective and also enhanced interdiffusion, resulting in what appears to be a substantial conversion of uranium to $UAl_3$, see also *Irradiation Tests of $^{99}$Mo Isotope Production Employing Uranium Metal Foils*, G. L. Hofman et al., presented at the 1996 International Meeting on Reduced Enrichment for Research and Test Reactors, Oct. 7–10, 1996, Seoul, South Korea.

Figure 3:
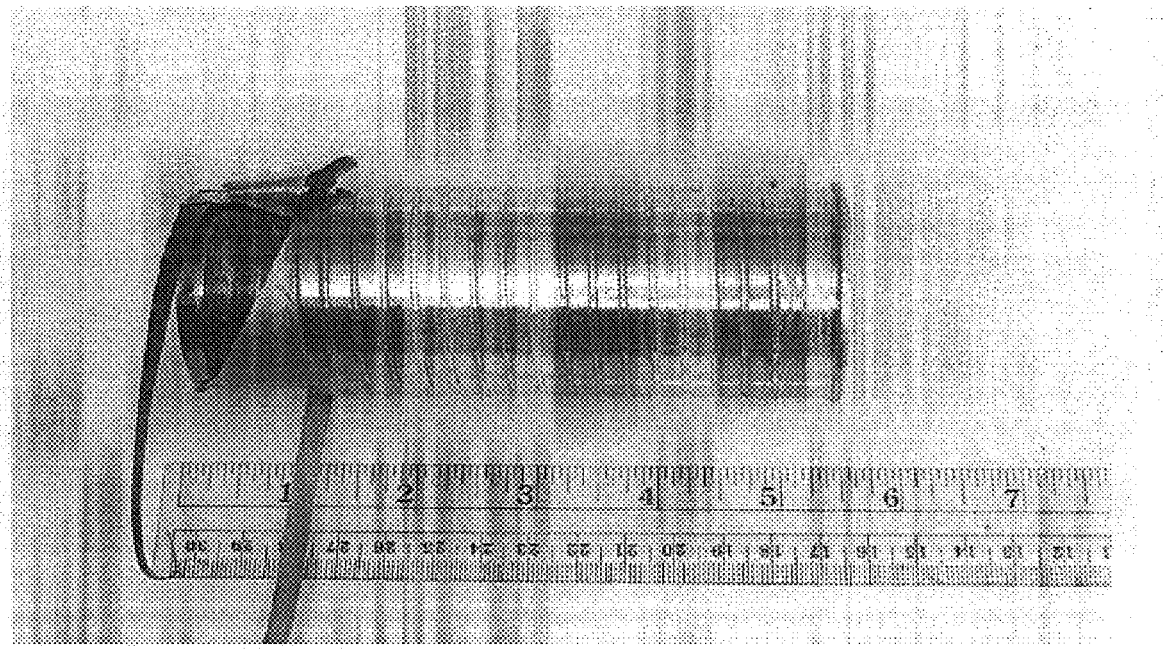
FIG. 3. is an illustration of a partially disassembled surrogate $^{99}$Mo target assembly.

Since the standard 10×10 cm (4×4") Mo-99 target foil requires large rolling press forces to fabricate, an alternate design was established using relatively narrow uranium ribbons. These ribbons are much more easily fabricated than a larger foil at lower required press clamping force. This new foil geometry necessitates a new target fabrication and disassembly method. The foil is wound in a helical pattern over the inner tube shell of the aluminum target body, and tack welded on both ends, see FIG. 3. Various metallic foils, such as, but not limited to nickel foil, can be placed under wound ribbon prior to winding, and over the ribbon prior to assembly of the outer can to prevent interdiffusion of the foil and can material. The target outer shell is then slid over the inner tube shell of the aluminum target body and welded closed at the ends. The inner target body is expanded so that it is in intimate contact with the foil and outer target body by using the standard methods of plug drawing or pressing. Disassembly involves scoring the target outer tube shell with a machine tool or other cutting head and "peeling" the outer tube shell away from the foil and inner tube shell. In order to protect the foil ribbon from damage, it is preferable to score the tube in a helical manner, all as shown in FIG. 3.

Initial rolling tests on cold rolling thin castings of unalloyed uranium and uranium 10 wt. % molybdenum alloy (U-10 Mo) were performed on four different samples. U-10Mo bar stock with a cross section of 0.32×0.64 cm (0.125"×0.25") was rolled to a thickness of 0.33 mm (0.013") in ribbon form. A U-10Mo coupon of size 2.5×2.0×0.22 cm (1"×0.80"×0.090") was also cold rolled to a thickness of 0.33 mm (0.013") with no intermediate annealing steps required.

An unalloyed depleted uranium (DU) bar sample of cross sectional dimensions 0.32×0.64 cm (0.125"×0.25") and length of 5 cm (2") was also rolled into a 0.2 mm (0.008") thick ribbon more than 22" long. During the cold-rolling process, the unalloyed uranium exhibited edge tearing. This was also observed in some steel samples used to develop the cold rolling reduction schedule. In order to address this problem in an economical manner, a resistance annealing process was developed and successfully tested using a stainless steel surrogate for uranium and its alloys. The uranium cold rolling process can be alternated, when needed, with these resistance annealing steps. The resistance annealing step is much more economical than the pack annealing process which has been previously used to anneal uranium foils during rolling reduction.

Resistance annealing relies on the inherent electrical resistivity of a material to raise its temperature. An electric current is passed through a foil or ribbon maintained under inert atmosphere, see FIGS. 4 and 5. For testing purposes, the current and voltage requirements for the ribbons are easily met by using a standard welding power supply. Power leads are attached to each end of the foil. The foil is encased in a glass tube or other inert atmosphere chamber and purged with argon gas to prevent oxidation during heating. Electrical current is transmitted through the foil until it reaches a temperature of 600°–1000° C. Heating is continued for a few seconds for annealing, for purposes of heat treatment to relieve hardness introduced by cold rolling, and may be prolonged for tens of minutes, if required. After the power is turned off the inert gas purge is continued several seconds until the foil has cooled, see FIGS. 4 and 5.

Figure 4:
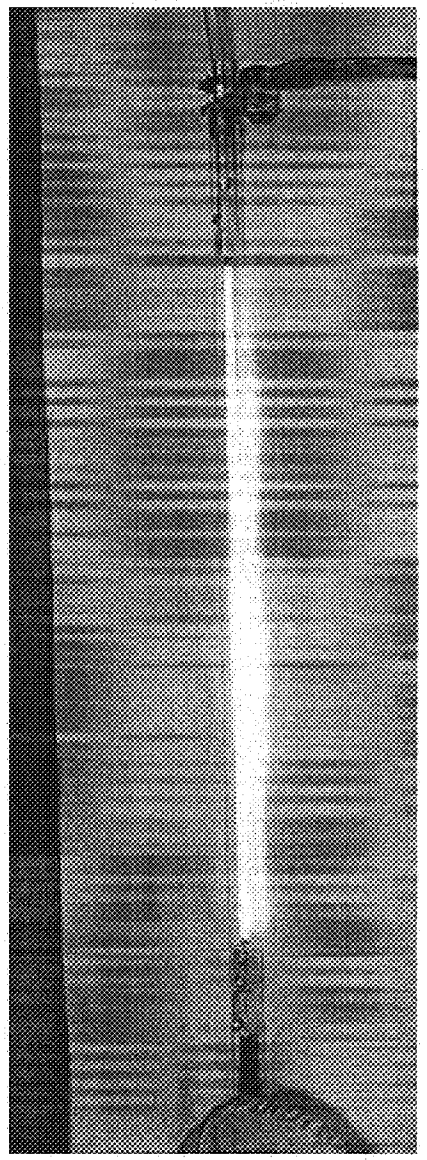
FIG. 4 is an illustration of the resistance annealing process.
Figure 5:
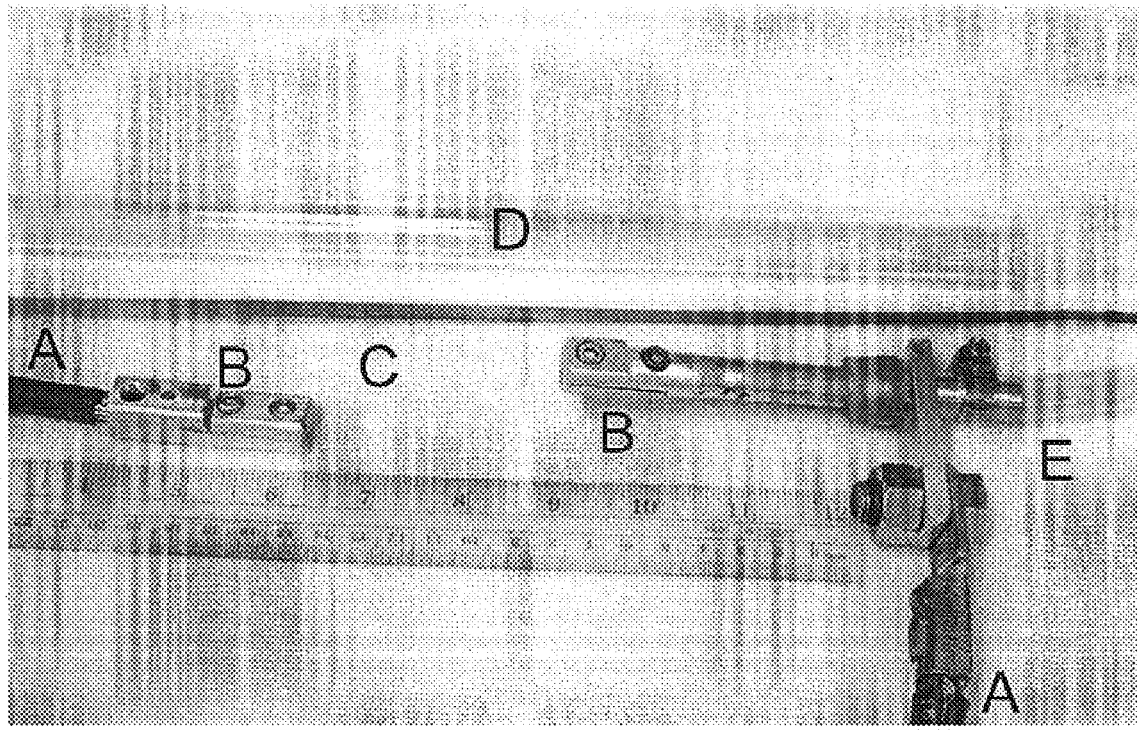
FIG. 5 is an illustration of the equipment used in the resistance annealing process.

The annealing process is shown in FIG. 4. Experimental equipment used for resistance annealing is shown in FIG. 5. The power leads (A) are attached to clamps (B). The clamps hold the foil (C) inside either end of a glass tube (D). Inert gas (E) is supplied through one of the clamps. If the foil alloy content or total required reduction does not allow cold-rolling to final thickness, the process outlined above results in a foil strip sufficiently annealed to continue the cold rolling process.

Target Design: The partially disassembled target shown in FIG. 3 was fabricated by wrapping nickel foil around an aluminum mandrel. The stainless steel surrogate foil ribbon was tack welded to the nickel foil and helical wrapped to the desired length on the mandrel. More than one section of the ribbon can be used in the assembly of a target. The final end is again tacked to the nickel foil to hold it in place. An additional layer of nickel foil was placed over the uranium surrogate. An aluminum outer sleeve was slipped over the foil layers and seal welded on both ends. Forcing a mandrel through the middle of the tube to expand the tube into intimate contact with the foil and outer tube to form a completed the assembly.

Although the invention has been described with respect to uranium metal, adjusted uranium metal, and uranium molybdenum alloy up to 12% by weight, other uranium alloys are intended to be included in the invention, such as alloys of uranium and one or more of Zr, Nb, Cr, Fe, Si, Mo, Ni, Cu and Al. An alloy of up to about 12% by weight molybdenum with the remainder being principally uranium is preferred for the research reactor fuel hereinbefore described, but other alloys are also useful. Cold rolling may be used as described above to reduce the thickness of the initial uranium or uranium alloy sheet from about 5 mm to thicknesses in the range of from about 0.1 mm to about 1.0 mm with thicknesses in the range of from about 0.1 mm to about 0.2 mm being particularly useful and preferred for targets and thicknesses in the range of from about 0.1 to about 0.5 mm being particularly useful and preferred for research reactor fuel.

Cold rolling can be employed to reduce the thickness by about 50% per cold rolling pass, but preferably not greater than 10%. When cold rolling introduces unacceptable strain hardening, tearing, residual stress or cracking in the uranium or uranium alloy metal, then annealing may be used to relieve the hardness or residual stress.

The inventive annealing step taught herein is a resistance heating wherein voltages on the order of 10 to about 100 volts, depending on the size and shape of the material being annealed, may be used to introduce a high current such as about 300 amps, by way of illustration only, to heat the uranium metal or alloy to the required temperature, below the melting point of the uranium metal or alloy to relieve the strain hardening therein. Resistance annealing may also be used as a method for final heat treatment of foils to develop a specific microstructure and phase array by the use of rapid cooling from the annealing temperature. For example, U—Mo alloys may be quenched into the metastable gamma-phase by using this process. As is known, when uranium or an alloy thereof is heated to annealing temperatures, a protective atmosphere must be used. Protective atmospheres which are useful in the present invention can be provided by any group VIIIA gases. However, argon and helium are preferred with argon being the most preferred inert gas.

Figure 6:
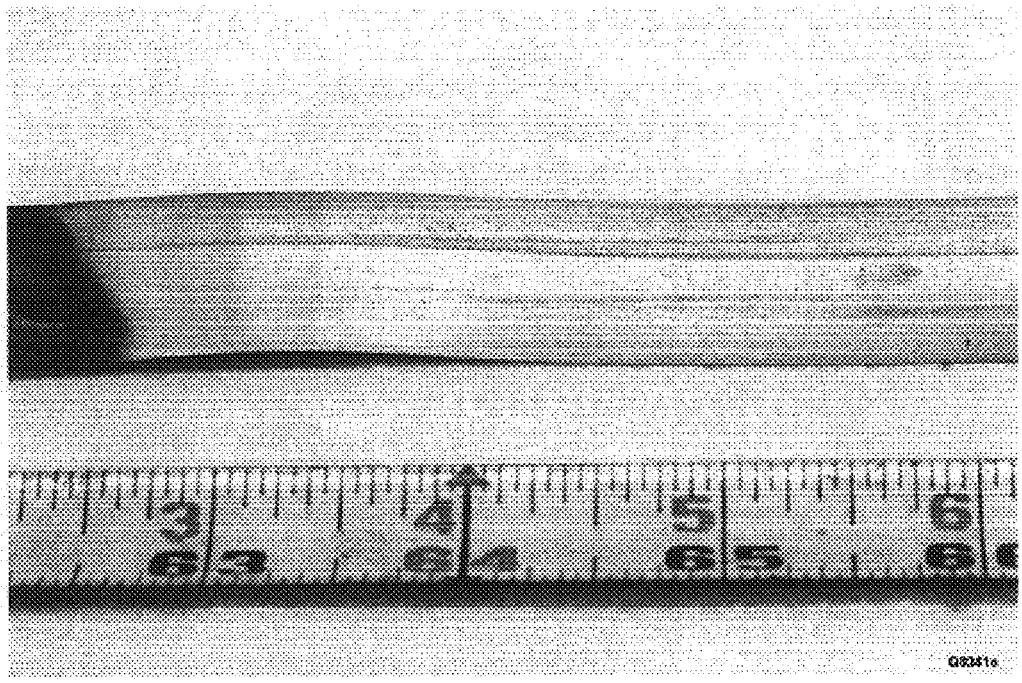
FIG. 6 is U-10% Mo foil made in accordance with this invention.
Figure 7:
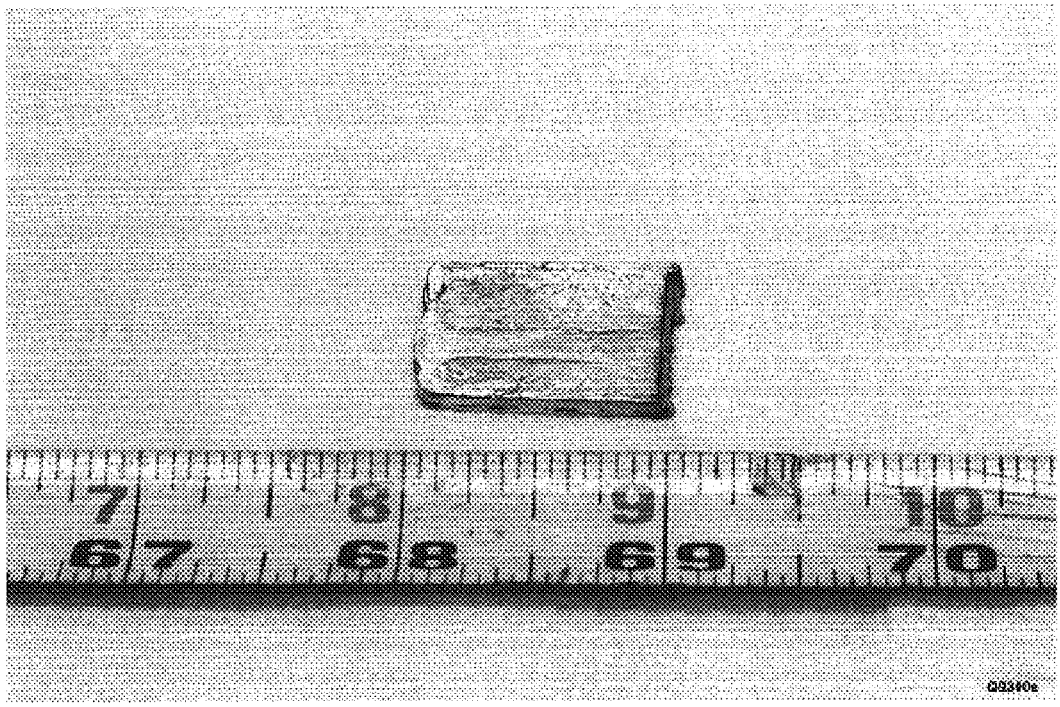
FIG. 7 is a U-10% Mo coupon made in accordance with this invention.

Generally, annealing of uranium or uranium alloys takes place at a temperature in the range of from about 600° C. to about 1100° C., depending on the metal being annealed. More particularly, annealing temperatures in the range of from about 600° C. to about 1000° C. may be particularly useful. An important aspect of the invention is the use of resistance annealing for very short times, usually less than about 10 minutes and preferably less than about one or two minutes. Preferably, during the annealing process the sheet or foil is maintained at annealing temperature in the range of from about 30 seconds to about 5 minutes. FIG. 6 and FIG. 7 show U-10% Mo foil (FIG. 6) and coupon prior to cold rolling (FIG. 7). The material in FIG. 6 was made from the coupon (or one like it) shown in FIG. 7 with a number of cold rolling passes.

While there has been disclosed what is considered to be the preferred embodiment of the present intention, it is understood that various changes in the details may be made without departing from the spirit, or sacrificing any of the advantages of the present invention.

The embodiments of the invention in which an exclusive property or privileges is claimed are defined as follows:

1. A method of producing thin foils of uranium or an alloy thereof, comprising casting the uranium or alloy thereof in a sheet having a thickness less than about 5 mm and thereafter cold rolling the uranium or alloy thereof in one or more passes at substantially ambient temperatures until the uranium or alloy thereof is in the shape of a foil having a thickness less than about 1.0 mm.

2. The method of claim 1, wherein the uranium alloy includes one or more of Zr, Nb, Mo, Cr, Fe Si, Ni Cu or Al.

3. The method of claim 1, wherein the uranium alloys is a U—Mo alloy.

4. The method of claim 3, wherein the alloy content ranges up to about 12% by weight Mo, the remainder being principally U.

5. The method of claim 1, wherein cold rolling reduces the thickness of the uranium or alloy thereof in the range of from about 0.2 mm to about 0.5 mm.

6. The method of claim 1, wherein cold rolling reduces the thickness of the uranium or alloy thereof in the range of from about 0.1 mm to about 0.2 mm.

7. The method of claim 1, wherein each cold rolling pass reduces the thickness of the uranium or alloy thereof by not greater than 50%.

8. The method of claim 5, wherein each cold rolling pass reduces the thickness of the uranium or uranium alloy thereof not greater than about 10%.

9. The method of claim 1, wherein multiple cold rolling steps are employed to reduce the thickness of the uranium or uranium alloy in the range of from about 0.1 mm to about 0.5 mm.

10. The method of claim 9, wherein at least some of the cold rolling steps are followed by resistance annealing the uranium or uranium alloy sheet or foil in a protective atmosphere to relieve strain hardening and residual stress introduced by cold rolling.

11. The method of claim 10, wherein the resistance annealing is accomplished by maintaining the uranium or alloy thereof at an elevated temperature for each annealing less than about 10 minutes.

12. The method of claim 11, wherein annealing is at a temperature in the range of from about 600° C. to about 1100° C.

13. The method of claim 1, further comprising rapidly annealing uranium or uranium alloy sheet or foil by applying an electrical potential across the sheet or foil to heat the sheet or foil to a temperature sufficient to relieve strain hardening and residual stress introduced by cold rolling.

14. The method of claim 13, wherein the annealing of uranium is at temperatures up to about 1100° C. under a protective atmosphere of a group VIIIA gas.

15. The method of claim 14, wherein the uranium alloy is a U—Mo alloy.

16. The method of claim 15, wherein the alloy is up to about 12% by weight Mo, the remainder being principally U.

17. The method of claim 15, wherein the annealing of uranium-molybdenum alloys is at temperatures up to about 1100° C. and below the melting point of the alloy.

18. The method of claim 13, wherein during each annealing the sheet or foil is maintained at annealing temperature for less than about 10 minutes.

19. The method of claim 18, wherein during each annealing the sheet or foil is maintained at annealing temperature in the range of from about 30 seconds to about 5 minutes.

20. The method of claim 14, wherein the group VIIIA gas is Ar or He.

21. The method of claim 20, wherein the group VIIIA gas is Ar.

* * * * *